US006280011B1

(12) United States Patent
Schloeman et al.

(10) Patent No.: US 6,280,011 B1
(45) Date of Patent: Aug. 28, 2001

(54) CIRCUIT AND ASSEMBLY WITH SELECTABLE RESISTANCE LOW VOLTAGE DIFFERENTIAL SIGNAL RECEIVER

(75) Inventors: Dennis J. Schloeman; Jeffery S. Beck; Adam L Ghozeil, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/375,477

(22) Filed: Aug. 16, 1999

(51) Int. Cl.[7] ..... B41J 29/38; B41J 2/05

(52) U.S. Cl. ..... 347/12; 347/59

(58) Field of Search ..... 347/59, 12; 327/52, 327/65, 563

(56) References Cited

U.S. PATENT DOCUMENTS

| | | | |
|---|---|---|---|
| 4,228,369 | 10/1980 | Anantha et al. | 307/270 |
| 4,860,166 | 8/1989 | Nicholls | 361/414 |
| 4,949,453 | 8/1990 | Neumann et al. | 29/620 |
| 5,196,742 | 3/1993 | McDonald | 307/355 |
| 5,381,034 | 1/1995 | Thrower et al. | 257/529 |
| 5,422,580 | 6/1995 | Mandel et al. | 326/30 |
| 5,473,264 | 12/1995 | Mader et al. | 326/30 |
| 5,553,250 | 9/1996 | Miyagawa et al. | 395/309 |
| 5,565,813 | 10/1996 | Connell et al. | 330/9 |
| 5,610,635 * | 3/1997 | Murray et al. | 347/7 |
| 5,635,761 | 6/1997 | Cao et al. | 257/700 |
| 5,635,873 | 6/1997 | Thrower et al. | 330/253 |
| 5,646,549 | 7/1997 | Yamamoto | 326/31 |
| 5,705,962 | 1/1998 | Fleeger et al. | 333/136 |
| 5,859,669 | 1/1999 | Prentice | 348/469 |
| 5,864,587 | 1/1999 | Hunt | 375/316 |
| 5,880,599 | 3/1999 | Bruno | 326/56 |
| 5,987,543 * | 11/1999 | Smith | 710/70 |

OTHER PUBLICATIONS

Gibilisco, Illustrated Dictionary of Electronics, McGraw–Hill, p. 118, 1997.*

Texas Instruments, Datasheet SLLS368C, pp. 1–3, Jul., 199.*

Fairchild Camera and Instrument Corporation, Full Line Condensed Catalog, p. 13–32, 1978.*

* cited by examiner

*Primary Examiner*—John Barlow
*Assistant Examiner*—Alfred Dudding

(57) ABSTRACT

An integrated circuit chip with a low voltage differential signaling receiver (LVDS). The receiver has first and second input lines, and an output line. The first input line is connected to a first input node on the chip, and the second input line connected via a termination resistor on the chip to a second input node on the chip. The second input line is connected to a third input node on the chip. The chip may be installed on a substrate with one or more identical chips, with the first nodes of each chip connected to a first conductor on the substrate, and a second conductor on the substrate connected to the third node of each chip. A second node on one of the chips is connected to the first conductor to involve the resistor.

8 Claims, 1 Drawing Sheet

CIRCUIT AND ASSEMBLY WITH SELECTABLE RESISTANCE LOW VOLTAGE DIFFERENTIAL SIGNAL RECEIVER

FIELD OF THE INVENTION

This invention relates to electronic circuits and ink jet printers, and more particularly to ink jet printer assemblies with multiple print heads.

BACKGROUND AND SUMMARY OF THE INVENTION

Ink jet printers employ print heads that reciprocate over a media sheet and expel droplets through an array of nozzles, onto the sheet to generate a printed image or pattern. To provide faster printer speeds without compromising print quality, print heads have been developed with longer nozzle arrays to provide a wider print swath. This has required proportionately larger print head chips, with attendant concerns of manufacturablility, wafer edge losses, and the fact that a single defect requires rejection of a more valuable component. In addition, certain applications may benefit from wider print swaths than can be practically provided by a single print head chip. Accordingly, assemblies with multiple print head chips can provide a wider print swath.

Multi-chip print head assemblies and other multi-chip assemblies may employ Low Voltage Differential Signaling (LVDS) to transmit high frequency data signals to the chips, such as on a clock line shared by all chips operating in concert. LVDS operates under the ANSI/TIA/EIA-644-1995 standard and the IEEE 1596.7-1996 standard, and provides a low-noise means for transmitting very high frequency data. This is particularly important as printer resolution and speed is increased, requiring a higher data rate for a given printed area. A receiver on each chip has a pair of input lines across which a terminating resistor is connected. The signal to the receiver is transmitted in the form of small current values that reverse direction to indicate changes in the data state. This generates a corresponding changing small voltage across the terminating resistor (from small positive to small negative values), in response to which the receiver generates an output signal at conventional logic voltage levels to other circuitry on the chip.

For multi chip assemblies sharing a parallel input line pair, the terminating resistance may be provided by a single resistor shared by all chips, or by a resistor at each chip. A single resistor will have the standard resistance, and multiple resistors will each have a resistance equal to the product of the standard resistor and the number of resistors. Typically, a component resistor may be installed across the input line pair, typically at the most remote component. However, the addition of one or more such components increases the size, complexity and cost of the assembly.

The resistor or resistors also may be provided internally to the chip(s). To eliminate the resistor component, a resistor may be provided across the line pair internally to the chips. If only one chip is provided with the standard-value terminating resistor and the others are without resistors, two types of chips must be inventoried, and kept segregated for manufacturing purposes. If identical chips each having a high value resistor (standard resistance x number of chips) are used, there are two disadvantages. First, the use of the large resistors of multiplied size requires area on the chip that increases chip size and cost. Second, a different chip design (with appropriately multiplied resistor value) is required for each assembly design using a different number of chips.

The present invention overcomes the limitations of the prior art by providing an integrated circuit chip with a low voltage differential signaling receiver (LVDS). The receiver has first and second input lines, and an output line. The first input line is connected to a first input node on the chip, and the second input line connected via a termination resistor on the chip to a second input node on the chip. The second input line is connected to a third input node on the chip. The chip may be installed on a substrate with one or more identical chips, with the first nodes of each chip connected to a first conductor on the substrate, and a second conductor on the substrate connected to the third node of each chip. A second node on one of the chips is connected to the first conductor to involve the resistor.

DETAILED DESCRIPTION OF A PREFERRED EMBODIMENT

Figure 1:
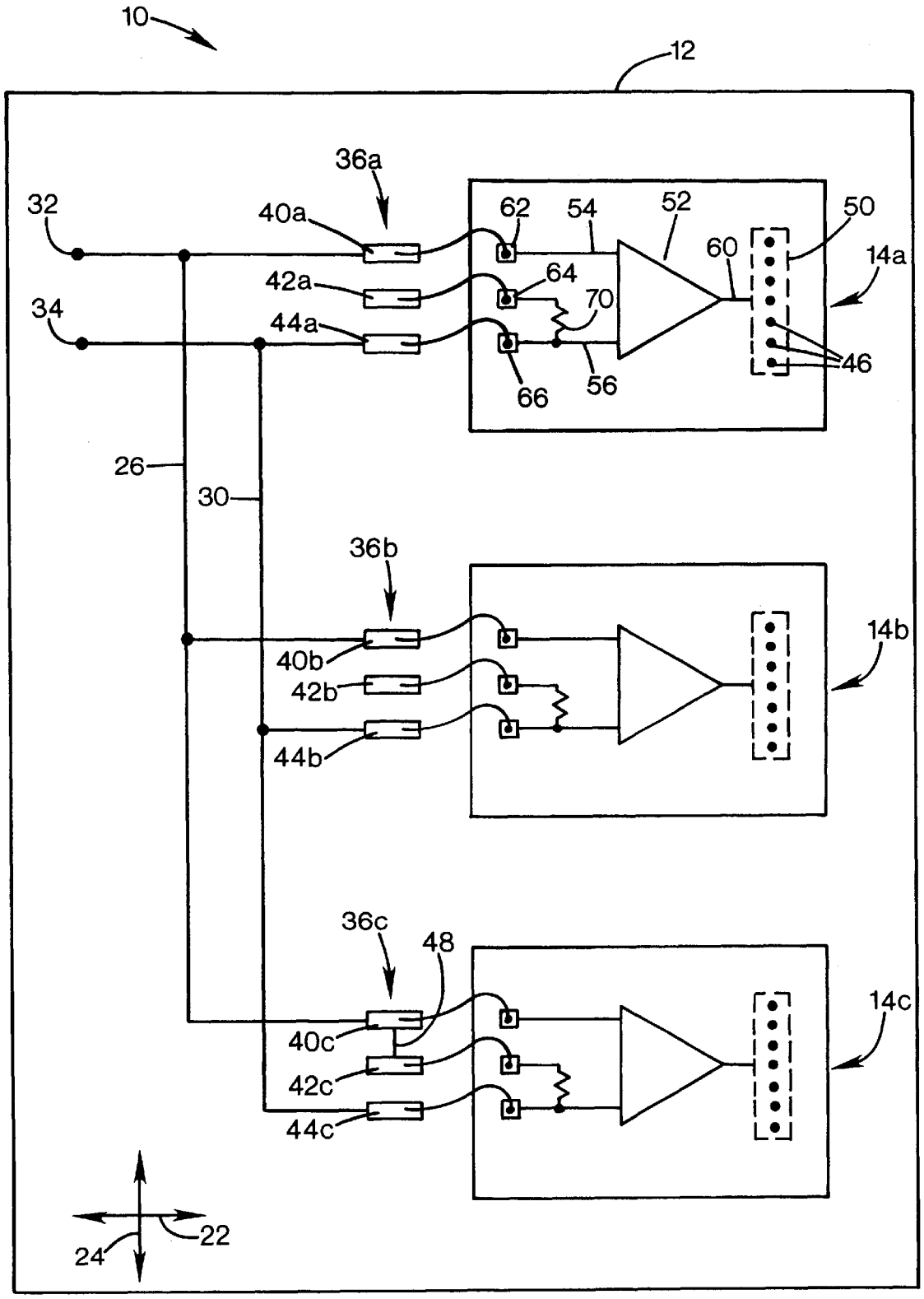
FIG. 1 is simplified plan view of an ink jet printing apparatus according to a preferred embodiment of the invention.

FIG. 1 shows an ink jet print head assembly 10 including a printed circuit board 12 that supports several integrated circuit print head chips 14*a*, 14*b*, 14*c*. The assembly 10 is connected to an ink jet printer that has a first operational axis 22 and a second perpendicular operational axis 24, both of which are parallel to the plane of the board 12. In one printer alternative, the first axis is the scan axis of a carriage that supports the assembly and which reciprocates over a media sheet that is incremented along a feed axis corresponding to the second axis 24. In another printer alternative, the assembly is fixed, and the first axis 22 represents a feed axis along which media is fed past the assembly for printing a single swath.

The circuit board is a rigid substrate having numerous conductive traces that connect between the printer's control circuitry and the print heads 14*a*, 14*b*, 14*c*. In alternative embodiments, the board may be a flex circuit or other substrate capable of supporting the chips and carrying the signals from the printer control circuitry and the chips. In the illustrated embodiment, only a first trace 26 and second trace 30 are shown. These traces extend from symbolically illustrated respective board input terminals 32, 34, which may include an interconnect or any other means of providing connection to printer control circuitry.

The conductive pattern on the board includes a bond pad array 36*a*, 36*b*, 36*c* associated with each print head. Each of the traces extends to each of the print heads, and is connected to at least one pad of each array. In the preferred embodiment, each pad array includes numerous pads surrounding all or part of each print head chip, and providing connection for numerous data input lines and other operational lines. For simplicity, the illustrated embodiment is shown with only those pads associated with the two traces 26, 30. These together transmit a clock signal in parallel, simultaneously to each chip, using LVDS standards referenced above. In the preferred embodiment, the bond pads have an identical pattern for each chip, which simplifies assembly processes by providing a single process shared identically for each chip. For chip 14*a*, pads 40*a*, 42*a*, 44*a* are provided; for chip 14*b*, pads 40*b*, 42*b*, 44*b* are provided; for chip 14*c*, pads 40*c*, 42*c*, 44*c*, are provided. Pads 40*a*, 40*b* and 40*c* are identically positioned with respect to the associated chip and the other pads of the associated array; pads 42*a*, 42*b*, and 42*c* are identically positioned with respect to the associated chip and the other pads of the associated array; Pads 44*a*, 44*b*, and 44*c* are identically positioned with respect to the associated chip and the other pads of the associated array.

The pads of the arrays of all but one chip are identically connected to the traces 26 and 30. In the illustrated embodiment with three chips, the most remote chip from the input terminals 32, 34, (that is, chip 14*c*) is connected differently. All the pad arrays have the first pad 40*a*, 40*b*, 40*c* connected to the first trace 26, and the third pad 44*a*, 44*b*, 44*c* connected to the second trace 30. However, the last array 36*c* is connected differently in that the second pad 42*c* is connected to the first pad 40*c* by a shorting trace 48, and thereby to the first trace 26. In all other arrays, the second pad is unconnected to either trace; in an alternative embodiment having the same function, the second pad of these arrays may be connected to the second trace or the adjacent third pad.

Each chip is identical in form, fit, and function to every other chip, such that the chips may all be produced from a single design, and randomly selected from a common batch of chips during the assembly process. Each chip is a functional print head including a linear or otherwise arranged array of nozzles or orifices 46. Printing circuitry 50 including firing resistors is associated with each orifice array and is shown symbolically.

Each print head chip includes a Low Voltage Differential Signal (LVDS) receiver 52. Each receiver has a pair of input lines 54, 56, and an output line 60 connected to printing circuitry 50. In the preferred embodiment, the chips operate to receive a high frequency clock data signal that is received in the form of varying positive and negative voltages derived from small current values that switch in flow direction to indicate changes in the data state. In response, the receiver generates an output signal at conventional logic voltage levels on the output line. The invention is not limited to clock lines, but may be used for any high speed data or control line, such as control data lines transmitting a signal shared by all chips.

Each chip has a multitude of input nodes or bond pads, three of which nodes 62, 64, 66 are associated with the receiver 52. The first node 62 is directly connected to the receiver first input line 54. The second node 64 is connected to the receiver input line 56 via a terminating resistor 70, and the third node 66 is directly connected to the receiver input line 56. Essentially, the resistor 70 is connected between the second and third nodes 64, 66. In the preferred embodiment, each print head chip is connected to the circuit board by connecting each input node 62, 64, 66 to a corresponding bond pad 40*a*, 42*a*, 44*a* on the circuit board. As assembled, the terminating resistor 70 of the last chip 14*c* effectively bridges between the first and second traces 26, 30, and thus serves to provide the needed resistance for all connected chips.

As illustrated, the connection is made by wire bonding, although alternative connection methods such as tab bonding or soldering of a chip carrier are suitable. As shown, connections are made to all bond pads, regardless of whether a connection is actually required for operation. This allows the connection process to be identical for each chip. For instance, a bonding machine may be programmed with a single sub-program usable for each chip. Also, a tab bond component may have identical portions for each chip. In addition, a soldered chip carrier may have a conventionally spaced array of solder pads, all of which may be connected without undermining the function of the device.

In the preferred embodiment, the resistor has a typical value of 110 ohms, tolerably ranging from 90 to 132 ohms according to LVDS specifications. While only three print heads are illustrated, it is contemplated that any number may be used, from as few as two to unlimited multitudes. The print heads are shown in a single column with their nozzle arrays arranged in a single line for simplicity, necessarily spaced apart at the array ends. In contemplated embodiments, the chips may be arranged in a staggered pattern so that the gaps between nozzle arrays are effectively covered by the chips positioned in an offset arrangement in an adjacent column. All print heads of such a design would be connected in the manner shown, with a single print head connected to involve its internal resistor, and the rest connected to bypass their internal resistors.

While the above is discussed in terms of preferred and alternative embodiments, the invention is not intended to be so limited.

What is claimed is:

1. An integrated circuit chip comprising:

a low voltage differential signaling receiver (LVDS) on the chip;

the receiver having a first input line and a second input line, and an output line;

the first input line connected to a first input node on the chip;

the second input line connected via a termination resistor on the chip to a second input node on the chip; and the second input line connected to a third input node on the chip; and ink jet print head circuitry connected to the output line.

2. An electronic circuit assembly comprising:

a substrate;

a plurality of integrated circuit chips connected to the substrate;

each chip having a low voltage differential signaling receiver (LVDS);

the receiver of each chip having a first input line and a second input line, and an output line;

the first input line of each receiver being connected to a first conductor on the substrate;

the second input line of each receiver being connected to a second conductor on the substrate;

the second input line of the receiver of a selected one of the chips being connected to the first conductor via a resistor on the chip;

the second input lines of the receivers of the chips other than the selected one chip being electrically isolated from the first conductor; and wherein each chip is a print head defining an array of orifices.

3. An ink jet print head assembly comprising:

a substrate;

a plurality of ink jet print heads each having an array of orifices, the chips connected to the substrate;

each print head having a low voltage differential signaling receiver (LVDS);

each print head having first, second and third input nodes connected to the receiver on the chip;

a resistor on each print head connected between the second input node and the third input node;

the first input node of each print head being connected to a first conductor on the substrate;

the second input node of a selected one of the print heads being connected to the first conductor via a resistor on the selected print head; and the third input node of each print head being connected to a second conductor on the substrate.

4. The apparatus of claim 3 wherein each receiver of each print head has a first input line and a second input line, and an output line, the first input line connected to the first input node, the second input line connected via the resistor on the chip to the second input node, and the second input line connected to the third input node on the chip bypassing the resistor.

5. The apparatus of claim 3 wherein all the chips are essentially identical, such that they may be randomly selected from a common production source.

6. The apparatus of claim 3 wherein the substrate includes a bond pad array associated with each print head, and wherein all of the pad arrays are essentially identical, such that each chip is connected to the substrate by a similar process.

7. The apparatus of claim 6 wherein each bond pad array includes first, second, and third bond pads, each connected to a corresponding one of the input nodes on the associated print head.

8. The apparatus of claim 7 wherein the first and second bond pads of a selected one of the bond pad arrays corresponding to the selected one print head are connected to each other.

* * * * *